US006416409B1

(12) United States Patent
Jordan

(10) Patent No.: US 6,416,409 B1
(45) Date of Patent: Jul. 9, 2002

(54) GAMING SYSTEM WITH SHARED PROGRESSIVE JACKPOT

(75) Inventor: Richard J. Jordan, Las Vegas, NV (US)

(73) Assignee: Mirage Resorts Incorporated, Las Vegas, NV (US)

( * ) Notice: Subject to any disclaimer, the term of this patent is extended or adjusted under 35 U.S.C. 154(b) by 0 days.

(21) Appl. No.: 09/444,248

(22) Filed: Nov. 19, 1999

Related U.S. Application Data

(60) Provisional application No. 60/109,368, filed on Nov. 21, 1998.

(51) Int. Cl.[7] ..... A63F 9/24

(52) U.S. Cl. ..... 463/27; 463/42

(58) Field of Search ..... 463/26, 27, 31, 463/42, 25; 273/138.1, 138.2, 139, 85 R, 143 R, 292, 433–39

(56) References Cited

U.S. PATENT DOCUMENTS 5,280,909 A * 1/1994 Tracy ..... 273/138 A
5,564,700 A * 10/1996 Celona ..... 463/27
5,626,341 A * 5/1997 Jones et al. ..... 273/292
5,797,794 A * 8/1998 Angell ..... 463/18
6,146,270 A * 11/2000 Huard et al. ..... 463/12
6,146,273 A * 11/2000 Olsen ..... 463/27

* cited by examiner

*Primary Examiner*—Mark Sager
*Assistant Examiner*—Steven Ashburn
(74) *Attorney, Agent, or Firm*—Quirk & Tratos

(57) ABSTRACT

A system and method are set for providing a progressive bonus to eligible devices in a set of linked gaming machines. A server is linked to the machines and from wagers accumulates a bonus pool. Each machine has a designated bonus outcome which, if obtained, causes the system to select from a set of displays, a bonus display for the machine. The bonus display remains until another bonus outcome is obtained and another bonus display is selected or the machine falls from the set of eligible machines based upon lack of play or the like. The system periodically selects a bonus prize and compares it to the bonus pool to make sure the pool is sufficient to award the prize. If the pool is greater than or equal to the selected prize, the system selects a winning bonus corresponding to a bonus display of the set and awards the prize to any eligible machine displaying the selected bonus display.

19 Claims, 5 Drawing Sheets

GAMING SYSTEM WITH SHARED PROGRESSIVE JACKPOT

CROSS REFERENCE TO RELATED APPLICATIONS

This application claims the benefit of U.S. Provisional Application No. 60/109,368, filed Nov. 21, 1998.

FIELD OF THE INVENTION

The present invention relates to a method and device for linked gaming. More specifically, the present invention is a method and device for issuing progressive bonuses at linked gaming machines.

BACKGROUND OF THE INVENTION

Players gamble to win and to be entertained. Thus, it is well known in the gambling industry that one of the best ways to attract and retain players is to make the player believe that he has a better chance of winning or that, if successful, he could win more. It is also known that players will tend to play the more exciting and entertaining games. Two methods which utilize this knowledge are progressive jackpots and bonuses.

In a progressive jackpot system, several interconnected gaming machines each contribute a portion of the wagers received by the gaming machine to a progressive jackpot. Because several gaming machines contribute to the progressive jackpot, the jackpot can grow large. Players place wagers and play a primary game at the interconnected gaming machines in a conventional fashion, such as by spinning the reels of a slot machine or by playing hands of video poker. The progressive jackpot is awarded when a player at one of the interconnected gaming machines obtains a predetermined jackpot outcome in the primary game. For example, in Celona (U.S. Pat. No. 5,564,700), a number of gaming machines are linked to a central controller. The central controller computes the amount of the progressive jackpot by adding a predetermined percentage of each wager made at each gaming machine to the progressive jackpot. The jackpot is paid when a player at one of the gaming machines obtains a jackpot-winning outcome. The jackpot is shared among all eligible players regardless of whether the player obtained a jackpot-winning outcome or not, although the player who obtains the jackpot-winning outcome will receive a larger portion of the progressive jackpot.

The drawback of progressive jackpots, however, is that a player at one of the interconnected gaming machines must obtain a jackpot outcome to trigger the progressive jackpot payoff. Consequently, progressive jackpot payoffs are usually rare occurrences and, thus, only marginally contribute to the entertainment value of the game.

By contrast, bonus systems typically pay players without requiring that any player obtain a particular primary game outcome. For example, in Acres et al. (U.S. Pat. No. 5,752,882) several gaming machines are linked to a floor controller. The floor controller selects less than all the linked gaming machines to receive bonus treatment. The floor controller compares wager information from the gaming machines to a fixed bonus minimum and monitors any other bonus criteria specified by the operator such as the time of day, the level of play, the time since the most recent bonus, or the like. When all the criteria are met, the bonus, corresponding to an altered pay table or a designated bonus outcome, is awarded.

The drawback of this system is that the selection of gaming machines to receive bonus treatment is completely random and unrelated to game play. Consequently, the bonus system does not contribute to the entertainment value of the game. Moreover, the criteria for turning on the bonus is a fixed bonus minimum. Thus, the frequency with which the bonus will be turned on will change dramatically depending on the number of players playing at the interconnected machines and the amount each player is wagering. Finally, the bonus minimum criteria is fixed; that is, the bonuses and the bonus pool are not exactly computed. Thus, it is possible that the bonuses will not be inadequately funded.

Thus, there is a need in the art for a progressive bonus system which awards a bonus related to the primary game, but without requiring an immediately preceding primary game outcome, when a dynamic bonus threshold is met.

SUMMARY OF THE INVENTION

The present invention is a method and device for distributing a progressive bonus to one or more players playing linked gaming machines. In the method of the present invention, a primary game is provided at a plurality of linked gaming machines. The player makes a wager and plays the primary game in a conventional fashion to obtain an outcome. In addition to the conventional outcomes, a bonus outcome is provided in the primary game. If the player obtains a bonus outcome, a bonus symbol is randomly selected from a plurality of bonus symbols. The gaming machine stores the selected bonus symbol until another bonus outcome is obtained or the gaming machine becomes inactive for a predetermined amount of time. The selected bonus symbol may be displayed at the gaming machine.

A portion of each wager wagered at the linked gaming machines is accrued in an accrual pool. A bonus award between a minimum bonus award and a maximum bonus award is randomly selected and the number of eligible gaming machines in play is determined. A gaming machine is determined to be in play by measuring the time since the most recent wager, or alternatively, measuring the time between wagers. A gaming machine is eligible when the player meets predetermined criteria such as wagering the maximum amount per game. A dynamic bonus threshold is calculated by multiplying the bonus award by the number of eligible gaming machines in play. In other words, the bonus threshold is the total amount that would be paid if every gaming machine in play issued the bonus award. The bonus threshold is compared to the accrual pool. If the accrual pool is less than the bonus threshold, a new bonus award is randomly selected and the bonus threshold is recalculated.

In one embodiment of the present method, when the accrual pool is equal to, or greater than, the bonus threshold, a bonus indicator is randomly selected from a plurality of bonus indicators which correspond to the bonus symbols. The bonus indicator is compared to the bonus symbols at each gaming machine. If at least one gaming machine has selected a bonus symbol corresponding to the selected bonus indicator, the bonus award is issued at all gaming machines displaying a bonus symbol corresponding to the selected bonus indicator. If no gaming machine has selected a bonus symbol corresponding to the selected bonus indicator, the selection process is repeated.

In an alternate embodiment of the present method, when the accrual pool is greater than, or equal to, the bonus threshold, the bonus symbols which have been selected by the gaming machines are detected. A bonus indicator is randomly selected from only those bonus indicators which correspond to selected bonus symbols. This insures that the selected bonus indicator will correspond to at least one selected bonus symbol. The bonus award is issued at all gaming machines which have selected a bonus symbol which corresponds to the bonus indicator.

In the device of the present invention, each of a plurality of gaming machines is electronically linked to a system server. At each gaming machine, a player deposits a wager as a token, coin, or bill. The machine accepts the wager in a manner known in the art. The gaming machine and the system server each includes a computer processor. The gaming machine processor communicates data representing the amount of the wager to the system server which adds a percentage of the wager to the accrual pool. The player plays the primary game in a conventional fashion with winning outcomes being paid and losing outcomes resulting in a loss to the player. If, however, the player obtains certain bonus outcomes in the primary game, the gaming machine processor randomly selects a bonus symbol from a plurality of bonus symbols stored in a first data structure. The gaming machine may include a plasma display which displays the selected bonus symbol. The gaming machine processor stores the selected bonus symbol in a second data structure until the player obtains another bonus outcome or the gaming machine becomes inactive for a pre-determined period of time. The gaming machine processor communicates data representing the outcome of the primary game, and any bonus symbol selected, to the system server.

The system server processor begins the selection process by randomly selecting a bonus award between a maximum and a minimum award. The system server processor also determines the number of eligible gaming machines in play. To determine how many machines are in play, the system server tracks the amount of time elapsed since each gaming machine received a wager, or alternatively, the amount of time elapsed between wagers. To determine eligibility of players, the system server examines the wagering data received from the gaming machines to detect whether the player is wagering the maximum amount per game. The product of the bonus award and the number of eligible gaming machines in play is the dynamic bonus threshold.

The system server processor compares the accrual pool to the bonus threshold. If the accrual pool is less than the bonus threshold, the system server processor randomly re-selects the bonus award and recalculates the bonus threshold. This process repeats until the accrual pool is equal to, or greater than, the bonus threshold.

According to one embodiment of the present device, when the accrual pool meets or exceeds the bonus threshold, the system server processor randomly selects a bonus indicator from a plurality of bonus indicators stored in a third data structure. The bonus indicators correspond to the bonus symbols stored in each gaming machine. The system server detects the bonus symbols, if any, selected by each gaming machine in play. If the bonus indicator selected by the system server matches the bonus symbol selected by at least one gaming machine, the system server communicates an instruction to all gaming machines having a bonus symbol corresponding to the bonus indicator to issue the bonus award. If no gaming machine displays a bonus symbol corresponding to the bonus indicator, the system server begins the selection process anew by randomly selecting a bonus award.

In an alternate embodiment of the present device, when the accrual pool meets or exceeds the bonus threshold, the system server processor detects which bonus symbols have been selected by gaming machines. The system server then selects a bonus indicator from only those bonus indicators which correspond to selected bonus symbols. In other words, the system server selects from a data structure which stores the possible bonus indicators depleted by the bonus indicators which have not had their corresponding bonus symbol selected by a gaming machine. Consequently, the system server processor will always select a bonus indicator corresponding to a bonus symbol selected by at least one gaming machine. The system server sends a signal to issue the bonus award at all gaming machines which have selected the corresponding bonus symbol.

An object of the present invention is to provide a method and device which may reward more than a single player. Another object of the present invention is to reward players based on a continuously active bonus indicia rather than the immediate outcome of the primary game. Yet another object of the invention is to provide a method and device which calculates a dynamic bonus threshold and compares the bonus threshold to the available pool before paying the bonuses to insure that the bonuses are adequately funded.

DESCRIPTION

Figure 1:
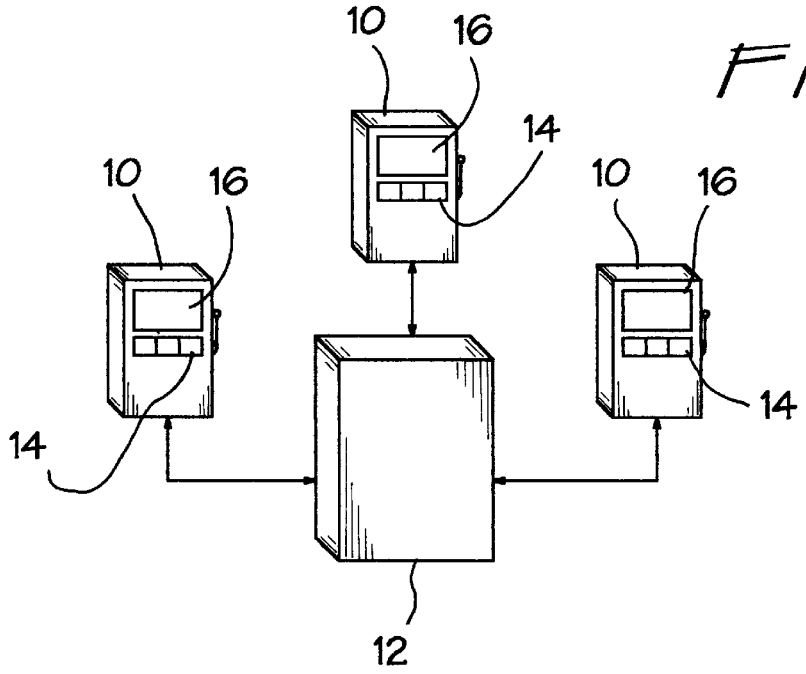
FIG. 1 shows a schematic diagram of the device of the present invention.

Reference is now made to the figures wherein like parts are referred to by like numerals throughout. Pictured in FIG. 1 is a gaming device according to the present invention adapted to practice the method disclosed herein. A plurality of gaming machines 10 are electronically linked to a system server 12 to enable the gaming machines 10 to communicate data to the system server 12 and the system server 12 to issue commands to the gaming machines 10.

Figure 2:
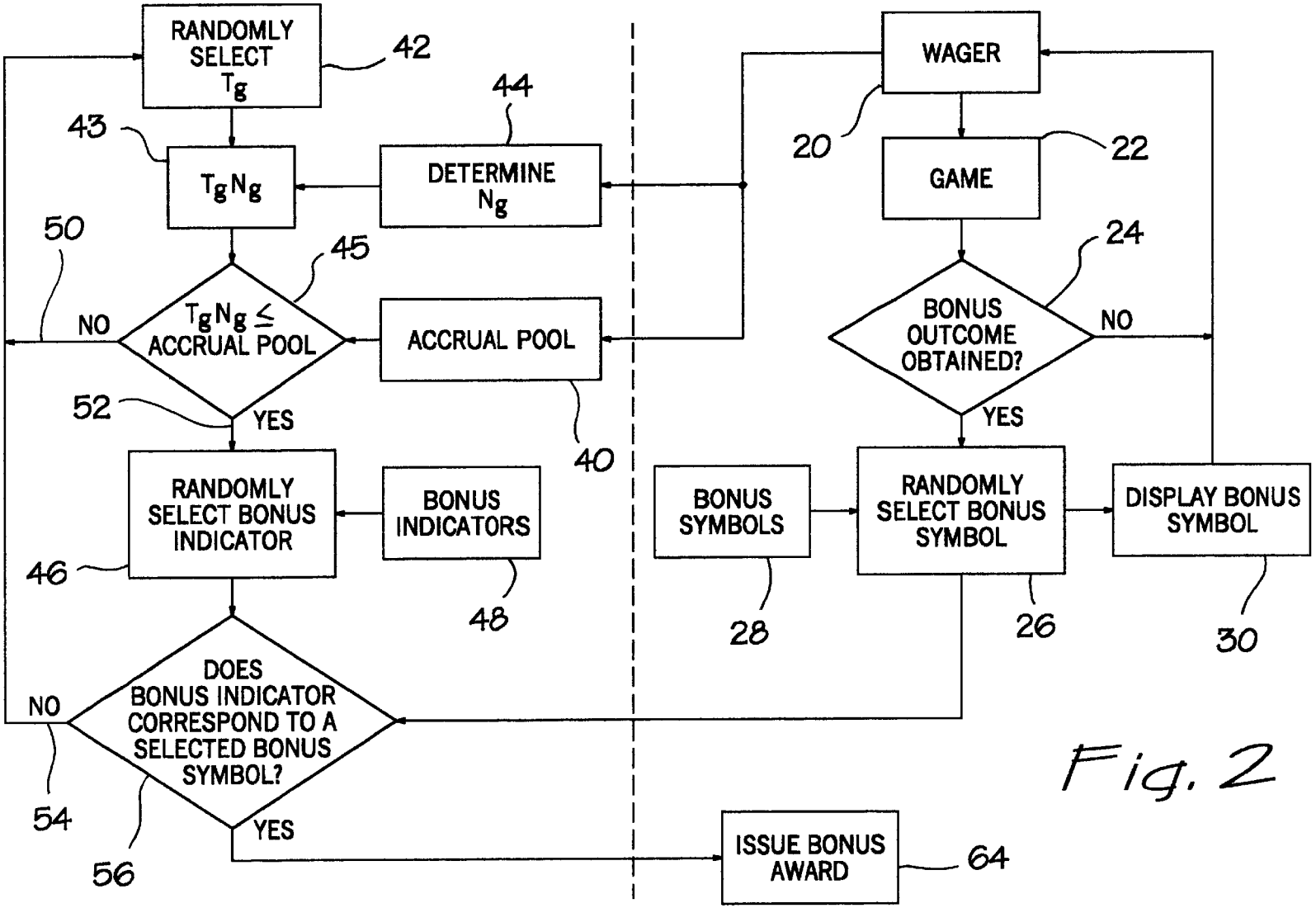
FIG. 2 shows a logic diagram of the method of the present invention.
Figure 3:
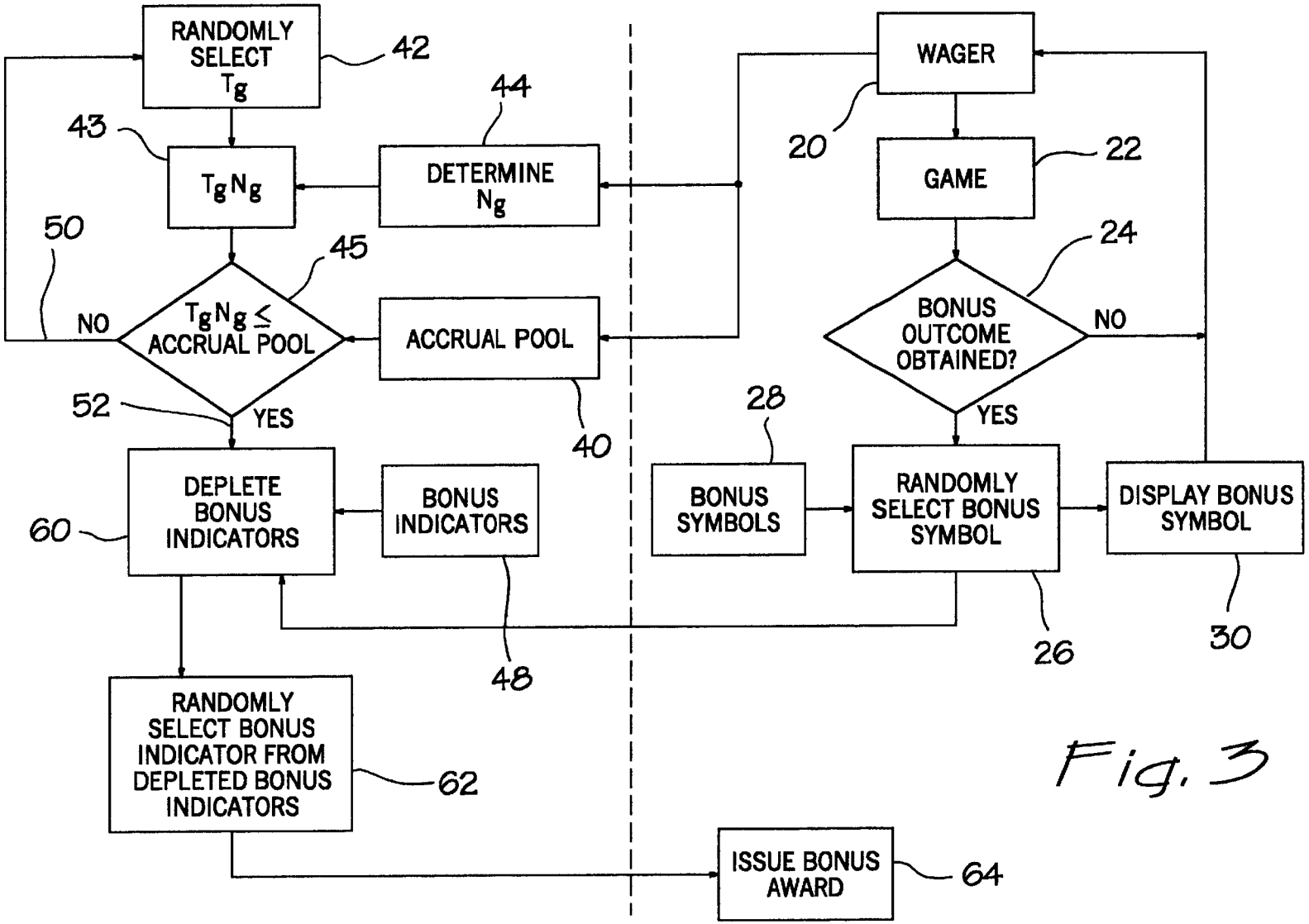
FIG. 3 shows a logic diagram according to another embodiment of the method of the present invention.

Referring now to FIG. 2, a player places a wager 20, as either a bill, token, or coin, at a gaming machine 10 in a manner known in the art. The gaming machine 10 accepts and verifies the wager 20, then signals to the gaming machine processor that the wager 20 has been accepted as well as the amount of the wager. The player then plays the game 22 in a conventional fashion. For example, if the game 22 is a slot machine, the player spins the reels; if the game 22 is video poker, the player signals the gaming machine processor to deal representations of five playing cards. The player obtains outcomes from the game 22 in a conventional fashion; that is, a winning outcome results in the player being rewarded and a losing outcome results in the players wager 20 being retained by the gaming machine 10. The outcomes are displayed at a gaming machine display 14. In addition to the conventional outcomes, there is also supplied at least one bonus outcome 24. When a player obtains a bonus outcome 24, the gaming machine processor selects at 26 a bonus symbol from a first data structure storing a plurality of bonus symbols 28. The data structure could be any suitable data structure such as random access memory, read-only memory, or computer readable media such as a hard disc, floppy disc, digital video disc (DVD) or CD. The bonus symbols 28 could be any plurality of symbols, words, or pictures or streaming video images. In a preferred embodiment, the bonus symbols 28 have a common theme related to the theme of the gaming machine game 22. For example, the bonus symbols 28 could each be depictions of well-known landmarks of cities of the world such as Paris, Rome, or Chicago and the theme of the game 22 could be global shopping.

The gaming machine processor stores the selected bonus symbol 26 in a second data structure and displays at a second display or at a location of the game display 14. The gaming machine 10 then continues with its normal operation by accepting a wager 20 for the next game 22. The selected bonus symbol 26 (e.g., a landmark of Chicago) is retained and displayed for all subsequent games until (1) another bonus outcome 24 is obtained and the gaming machine processor selects at 26 another bonus symbol (e.g., a landmark of Rome) or (2) the gaming machine 10 is inactive for a predetermined period of time implying that the player has left the machine or that the machine no longer qualifies for bonusing. In the example, if the bonus symbol Chicago were selected at 26 by the gaming machine processor, it would act as the bonus symbol 26 for that gaming machine 10 until another bonus symbol 26 is chosen or the gaming machine 10 is idle for a period of time set by the operator or is otherwise de-selected from the set of machines 10 entitled to participate in the bonus. Thus, to receive bonus treatment, it is not required that the player obtain the bonus outcome 24 immediately preceding the bonus award because the selected bonus symbol 26 will be retained for any subsequent bonus award periods. Thus, a player could obtain a bonus outcome at 24, and have the gaming machine processor select a bonus symbol at 26, many games 22 in advance of the awarding of the bonus award and still receive bonus treatment if the player is eligible as hereinafter described.

In a preferred embodiment, the gaming machines 10 each include a plasma display 16 for displaying at 30 the selected bonus symbol 26 or a representation of the selected bonus symbol 26. For example, if Chicago were selected, the plasma display 16 may show the word "Chicago" or it may show photographs or animations of sights in and around Chicago. Similarly, the plasma display 16 may be used to display at 30 photographs, pictures, or animations at specified points during the course of a game 22 or a bonus session. Other bonus symbols and presentations could be used such as movie stars, animals, storefronts or the like.

The gaming machines 10 are connected to a system server 12. As each wager 20 is made, the system server 12 adds a specified portion of the wager 20 to an accrual pool 40 stored in a third data structure.

As the gaming machines 10 operate, the system server 12 operates concurrently to determine whether a bonus award should be issued. The system server 12 includes a system server processor receiving input from each of the linked gaming machines 10. At 42, the system server processor randomly selects a game threshold, $T_g$, which is an integer between a fixed maximum game threshold, $T_{gmax}$, and a fixed minimum game threshold, $T_{gmin}$, inclusive. The possible game thresholds are evenly weighted so there is an equal probability that any integer value between $T_{gmax}$ and $T_{gmin}$ inclusive will be selected as $T_g$. The purpose of $T_g$ is to calculate the amount of money that would be required to pay the bonuses. In one embodiment, the bonus threshold, $T_g$, is equal to the bonus award. In this embodiment, the use of $T_g$ in the calculations would yield the exact amount of money required to pay the bonus awards.

In an alternate embodiment, an extra step of selecting a bonus award is used. The bonus award is selected by the system server processor from a weighted pay table stored in a suitable data structure. In this embodiment, the use of $T_g$ yields an estimate of the amount of money required to pay the bonus awards. To yield an accurate estimate, the operator specifies $T_{gmin}$ and $T_{gmax}$ so that the mean of $T_{gmin}$ and $T_{gmax}$ is equal to the average bonus award. For example, if, according to the weighted pay table, the average bonus award is fifty coins per machine per session, the operator could set $T_{gmin}$ at thirty coins and $T_{gmax}$ at seventy coins. Thus, the mean would be fifty coins. This would insure that, on average, the bonus award is adequately funded.

At step 44, the system server 12 determines the number of eligible gaming machines 10 in play, Ng. To determine whether a gaming machine 10 is in play, the system server processor detects the time since the most recent wager 20, or alternatively, the time between wagers 20 and, if desired, the amount of the wager to encourage the player to wager a maximum amount. If a gaming machine 10 has been idle for a specified period of time, it is assumed that the player has left the gaming machine 10 and, thus, the gaming machine 10 will not receive bonus treatment.

The gaming machine operator may set any eligibility criteria. However, in a preferred embodiment, a player must wager 20 the maximum amount per game 22 for the player's gaming machine 10 within a predetermined time interval from the last maximum wager to commence and continue eligibility. In a preferred embodiment, the gaming machine processor will communicate data to a display to display the gaming machine's eligibility status.

At step 43, the dynamic bonus threshold is calculated. The dynamic bonus threshold is the product of the game threshold and the number of eligible gaming machines 10 in play. Thus, the following formula is used:

$$\text{Dynamic Bonus Threshold}=T_g N_g.$$

The dynamic bonus threshold may be continuously updated or, alternatively, the operator may specify some other criteria to determine the frequency of the updates. For example, the operator may specify that the dynamic bonus threshold be updated according to a set period. Thus, an operator could instruct the system processor to update the dynamic bonus threshold every two minutes. Likewise, the operator may specify that the dynamic bonus threshold update every time there is a specified change in the number of eligible gaming machines 10. For example, the operator may specify that the dynamic bonus threshold update every time the number of eligible gaming machines changes by two or more.

The dynamic bonus threshold is compared to the accrual pool 40 at step 45. If the accrual pool 40 is less than the dynamic bonus threshold, the system server processor randomly re-selects a game threshold and recalculates the bonus threshold as shown at 50. If the accrual pool 40 is greater than, or equal to, the dynamic bonus threshold, the system server processor selects a bonus indicator 46 as shown at 52.

In one embodiment of the method and device of the present invention, the system server processor selects a bonus indicator 46 from a plurality of bonus indicators 48 stored in a fourth data structure. Each of the bonus indicators 48 corresponds to a bonus symbol 28 stored at the gaming machines 10. For example, the player could be rewarded when the selected bonus indicator 46 matches the selected bonus symbol 26 at the gaming machine 10; that is, the player wins the bonus award when the bonus symbol "Chicago" matches the bonus indicator "Chicago." The system server processor detects which of the bonus symbols 28 have been selected by the gaming machines 10 within the set of eligible machines and compares the selected bonus indicator 46 to the selected bonus symbols 26 at step 56. If the selected bonus indicator 46 corresponds to at least one of the bonus symbols 26 selected at the gaming machines 10, the system server processor communicates a command to issue the bonus award 64 at all the eligible gaming machines 10 in play which have selected at 26 the bonus symbol corresponding to the bonus indicator 46. In other words, if the bonus indicator is the city "Chicago," the system server processor would communicate a command 64 to issue the bonus award at all eligible gaming machines 10 in play which have selected and displayed "Chicago" as a bonus symbol. If the selected bonus indicator 46 does not correspond to at least one bonus symbol selected at 26 by a gaming machine 10 in the set of eligible machines, the bonus indicator selection process is restarted by the system server processor selecting a new $T_g$ as shown at 54.

In an alternate embodiment, the system server processor detects which bonus symbols 28 have been selected by the gaming machines 10. The system server processor compares the selected bonus symbols 26 to the possible bonus indicators 48 stored in a fourth data structure. At 60, the system server processor depletes the possible bonus indicators 48 by removing those bonus indicators which do not correspond to selected bonus symbols 26 and storing the remaining bonus indicators in a fifth data structure. At step 62, the system server processor then selects a bonus indicator from the bonus indicators stored in the fifth data structure. Thus, the system server processor will not select a bonus indicator 62 which will not correspond to a selected bonus symbol 26. For example, if the possible bonus indicators 48 are Paris, Rome, and Chicago, and no linked gaming machine 10 has selected Paris, at step 62 the system server processor will select from Rome or Chicago only. The system server processor then communicates a command 64 to the gaming machines 10 to issue the bonus award at all eligible gaming machines 10 in play which have selected at 26 a bonus symbol corresponding to the selected bonus indicator 62.

Figure 4:
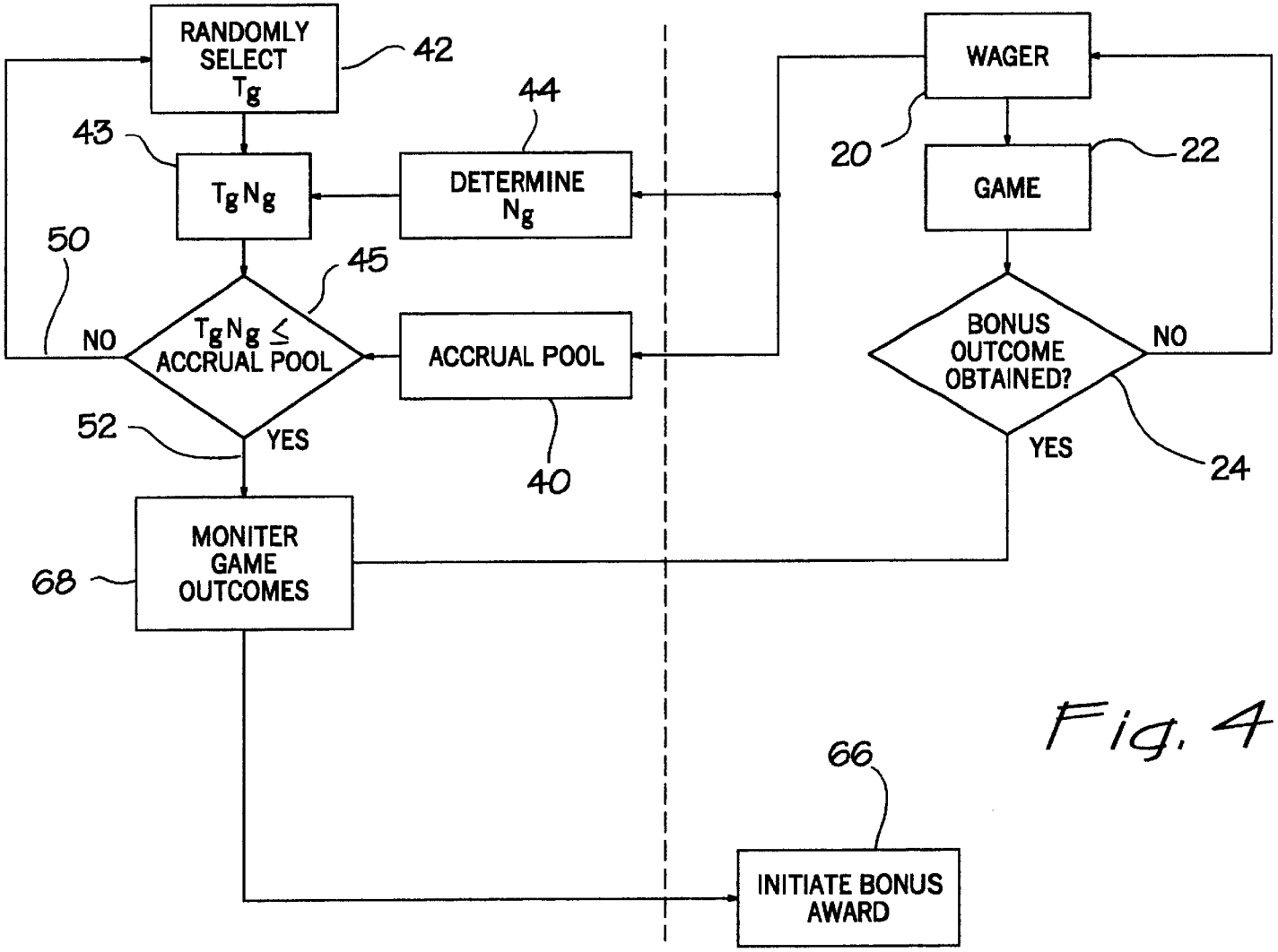
FIG. 4 shows a logic diagram according to another embodiment of the method of the present invention.

Referring now to FIG. 4, in another embodiment of the method and device of the present invention, rather than selecting a bonus indicator when the accrual pool 40 is equal to, or greater than, bonus threshold, the system server processor monitors the outcomes of the games 22 at the gaming machines 10 at step 68. When a bonus outcome 24 is obtained at any of the gaming machines 10, the system server processor communicates a command to the gaming machines 10 to issue the bonus award at all eligible gaming machines 10. Eligibility, as heretofore described, is preferably determined by detecting whether the player had wagered the maximum amount per game 22.

In yet another embodiment, rather than awarding the bonus award, the system server processor communicates a command to the gaming machines 10 having a selected bonus symbol 26 corresponding to the bonus indicator to initiate a bonus session 66 wherein the player is given the opportunity to win the bonus award through a bonus session of chance or outcomes or a sport such as "free kicks" in soccer. For example, the bonus session 66 could have a sports theme where the amount of the bonus award awarded is proportional to the number of "free soccer kicks" the player makes during a timed period.

Figure 5:
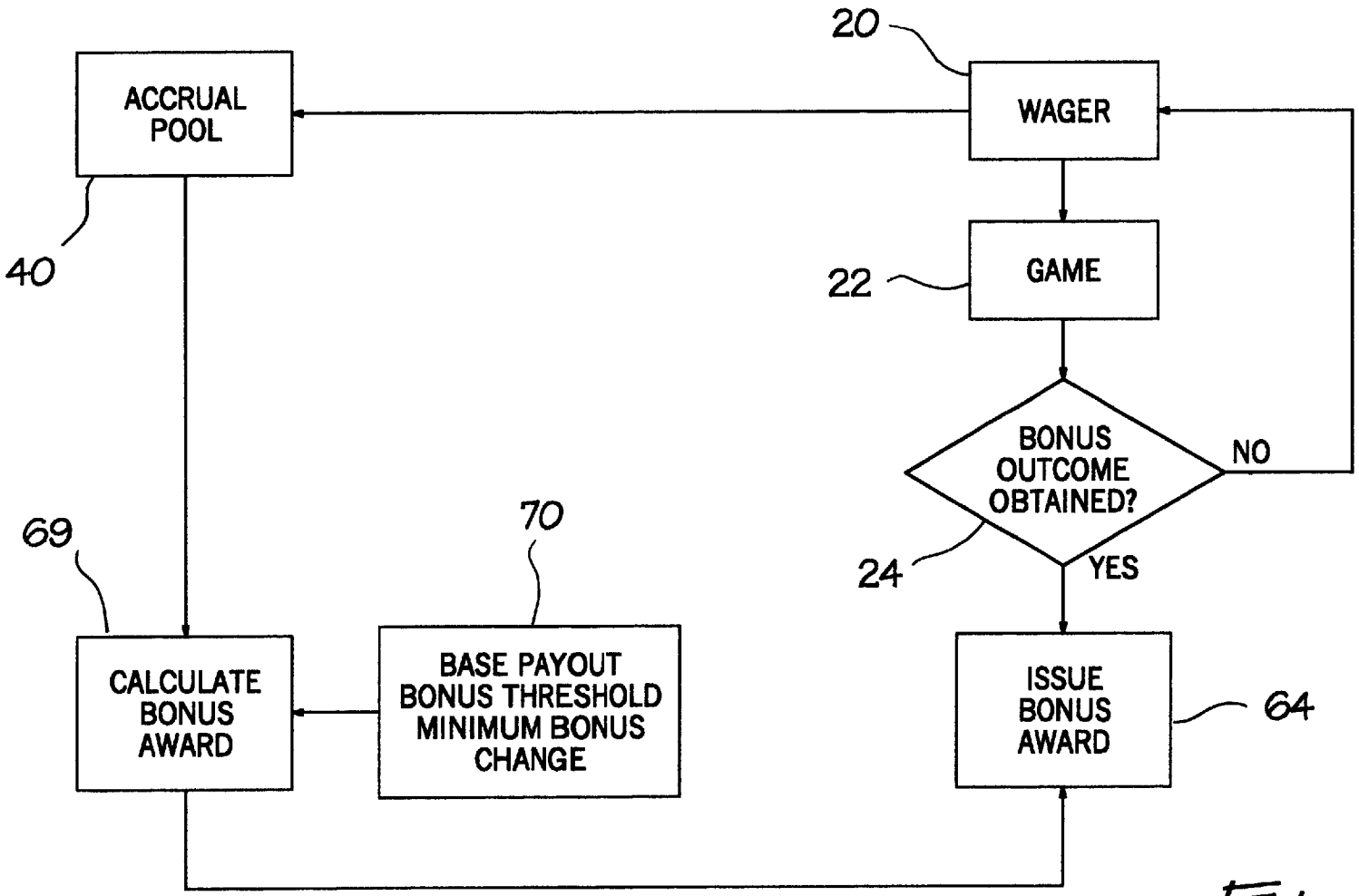
FIG. 5 shows a logic diagram according to another embodiment of the method of the present invention.

In a further embodiment of the present invention shown in FIG. 5, the bonus threshold is fixed but the size of the bonus award is controlled to insure that the bonuses are adequately funded. The operator inputs a base payout, a bonus threshold, and a minimum bonus change at step 70. The system server processor initializes the bonus award at the base payout amount. A portion of each wager 20 made at any of the linked gaming machines 10 is added by the system server processor to the accrual pool 40. The amount of the bonus award is calculated at step 69.

Figure 6:
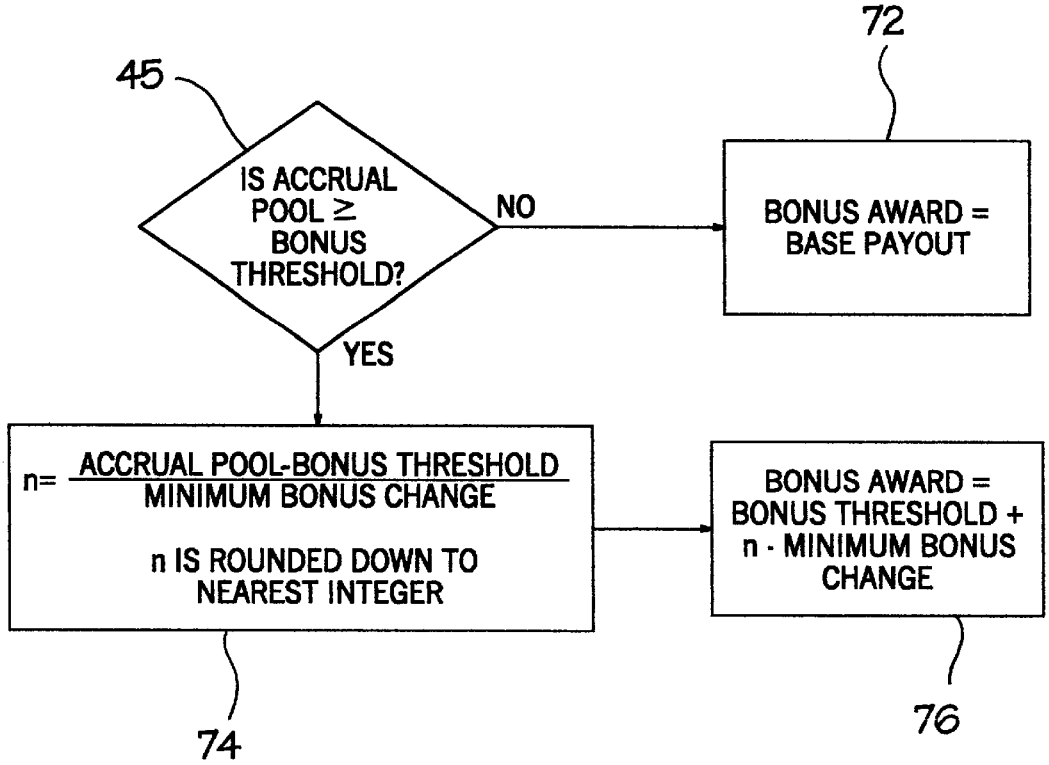
FIG. 6 shows a more detailed logic diagram of the step of calculating the bonus award according to the embodiment of FIG. 5.

FIG. 6 shows a detailed flowchart of step 69. At step 72, when the accrual pool 40 reaches the bonus threshold, the system server processor updates the bonus award to the bonus threshold amount. Thus, if the base payout were ten and the bonus threshold were fifty, the bonus award would be initialized at ten and remain ten until the accrual pool 40 is equal to, or greater than, fifty, at which point the bonus award would be updated to fifty. As the accrual pool 40 increases beyond the bonus threshold, the bonus award is updated in increments equal to the minimum bonus change. Thus, if the minimum bonus change were twenty, the bonus award would be increased in multiples of twenty each time the accrual pool 40 increased by twenty or more as shown in steps 74 and 76. In the above example, the bonus award would be fifty until the accrual pool 40 met or exceeded seventy, at which time the bonus award would be updated to seventy, and so on.

When a player obtains a bonus outcome 24 in the game 22, the system server processor signals the amount of the bonus award to the gaming machine 10 at which the bonus outcome 24 was obtained. The gaming machine 10 then issues the bonus award or initiates a bonus session in which the player is given the opportunity to win the bonus award through the bonus game. In a preferred embodiment, the bonus game is a maze though which the gaming machine processor maneuvers a marker to reach a goal. If the goal is reached, the bonus award is issued; if the goal is not reached, the bonus award is retained.

When the bonus award is issued, the gaming machine processor may communicate data to the plasma display 16 to display a message, picture, or animation indicating to the player that a bonus award has been issued.

An advantage of the present invention is that the bonus method and device rewards more than a single player because all players with a selected bonus symbol 26 corresponding to the selected bonus indicia 46 are rewarded. Moreover, players are rewarded based on a continuously active bonus indicia rather than the immediate outcome of the primary game because the selected bonus symbol 26 is used for all subsequent bonus awards until the machine becomes inactive or another bonus outcome 24 is obtained. Finally, the present method and device calculates a dynamic bonus threshold and compares the bonus threshold to the accrual pool before paying the bonus awards to insure that the bonus awards are adequately funded.

While I have shown and described certain embodiments of the present invention it is to be understood that it is subject to many modifications and changes without departing from the spirit and scope of the appended claims.

I claim:

1. A system for issuing a bonus award including a group of gaming devices each adapted to receive a wager, to select an outcome and to display the outcome, at least one outcome designated as a bonus outcome, the system comprising:

a bonus server;

a communication network to provide communication between the server and each machine of the group, each device sending data to the server corresponding to the making and the amount of each wager;

a data structure storing a plurality of bonus displays;

means for selecting each time a bonus outcome is obtained a bonus display selected from the data sturcture;

means for displaying each time a bonus outcome is obtained a bonus display selected from the data structure;

means for comparing for each device criteria of at least one of time since last wager and/or amount of last wager to preselected criteria to determining which device is eligible for a bonus to define a bonus eligible set of devices (Ng);

said server adapted to accumulate from a portion of said wagers to define a bonus pool (BP);

said server adapted to periodically select a bonus threshold (Tg) between a minimum threshold (Tmin) and a maximum threshold (Tmax), and if BP is greater than or equal to Tg multiplied by Ng then randomly select data corresponding to a winning bonus display and issue said bonus award Tg on a pro rata basis to any machine displaying said bonus display.

2. The system of claim 1 including said displays adapted to display said selected bonus display until (1) obtaining a bonus outcome whereupon a bonus display is re-selected from said data structure or (2) said device falls from the set Ng.

3. The system of claim 1 wherein each device includes a game display to display game outcomes and a separate bonus display to display said selected bonus outcome.

4. The system of claim 3 wherein said bonus display is a video display.

5. The system of claim 4 wherein said data structure includes data corresponding to a plurality of video presentations, each define a bonus outcome.

6. The system of claim 5 wherein each video presentation corresponds to a depiction of a landmark.

7. The system of claim 6 wherein each video presentation corresponds to a landmark associated with a geographic location.

8. The system of claim 7 wherein each video presentation corresponds to a depiction of a landmark associated with city.

9. The system of claim 1 including said server adapted to select said Tg in a pseudo-random fashion.

10. The system of claim 9 including said server adapted to weigh the selection of Tg based upon probabilities related to a standard deviation between Tmin and Tmax.

11. A method for awarding a bonus of a progressively accumulated jackpot to at least one of a group of networked gaming devices each adapted to receive a wager from a player, to select and display a game outcome, the method comprising:

providing a server and a communication link between the server and each device of the group;

each device sending to the server data corresponding to when and the amount of wagers made;

designating an outcome for each device as a bonus outcome;

selecting and displaying at the device each time a bonus outcome is obtained from a data structure storing data corresponding to bonus displays a bonus display;

comparing for each device criteria of at least one of time since last wager and/or amount of last wager to preselected criteria to determine which device is eligible for a bonus to define a bonus eligible set of devices (Ng);

accumulating from a portion of said wagers to define a bonus pool (BP);

periodically selecting a bonus threshold (Tg) between a minimum threshold (Tmin) and a maximum threshold (Tmax), comparing said bonus threshold Tg to said bonus pool BP and if BP is greater than or equal to Tg multiplied by Ng then selecting data corresponding to a winning bonus display;

comparing any bonus displays at the device of the set Ng; and issuing said bonus award Tg on a pro rata basis to any device of the set Ng displaying said winning bonus display.

12. The method of claim 11 including randomly selecting from the data structure said bonus displays.

13. The method of claim 11 including randomly selecting Tg.

14. The method of claim 11 including selecting Tg in a pseudo-random fashion.

15. The method of claim 11 including displaying said bonus display at a dedicated display therefor.

16. The method of claim 11 including selecting said bonus display from a data structure containing data corresponding to video presentation bonus displays.

17. The method of claim 16 including selecting from a data structure containing data corresponding to a video presentation of a landmark.

18. The method of claim 11 including displaying the bonus display until the player obtains another bonus outcome in which event another bonus display is selected or the device is no longer included in Ng.

19. A method for awarding a bonus of a progressively accumulated jackpot to at least one of a group of networked gaming devices each adapted to receive a wager from a player, to select and display at a game display a game outcome, the method comprising:

providing a server and a communication link between the server and each device of the group;

each device sending to the server data corresponding to when and the amount of wagers made;

designating an outcome for each device as a bonus outcome;

selecting and displaying at a separate display at the device each time a bonus outcome is obtained from a data structure storing data corresponding to images representing discrete geographic locations each representing a bonus display;

comparing for each device criteria of at least one of time since last wager and/or amount of last wager to preselected criteria to determine which device is eligible for a bonus to define a bonus eligible set of devices (Ng);

accumulating from a portion of said wagers to define a bonus pool (BP);

periodically selecting a bonus threshold (Tg) between a minimum threshold (Tmin) and a maximum threshold (Tmax), comparing said bonus threshold Tg to said bonus pool BP and if BP is greater than or equal to Tg multiplied by Ng then selecting data corresponding to a winning bonus display;

comparing any bonus displays at the device of the set Ng to said selected data representing said winning bonus display; and issuing said bonus award Tg on a pro rata basis to any device of the set Ng displaying said bonus display.

* * * * *

UNITED STATES PATENT AND TRADEMARK OFFICE

CERTIFICATE OF CORRECTION

PATENT NO. : 6,416,409 B1
DATED : July 9, 2002
INVENTOR(S) : Richard J. Jordan

It is certified that error appears in the above-identified patent and that said Letters Patent is hereby corrected as shown below:

Column 8,
Line 33, change “though”, to -- through --;

Signed and Sealed this

Eleventh Day of February, 2003

JAMES E. ROGAN
*Director of the United States Patent and Trademark Office*